US006635039B1

(12) United States Patent
Levy

(10) Patent No.: US 6,635,039 B1
(45) Date of Patent: Oct. 21, 2003

(54) PACKAGE FOR CARRYING PLURAL PANTILINERS

(75) Inventor: Ruth Levy, Collegeville, PA (US)

(73) Assignee: Tyco Healthcare Retail Services AG (CH)

( * ) Notice: Subject to any disclaimer, the term of this patent is extended or adjusted under 35 U.S.C. 154(b) by 303 days.

(21) Appl. No.: 09/619,158

(22) Filed: Jul. 19, 2000

(51) Int. Cl.[7] ..... A61F 13/15

(52) U.S. Cl. ..... 604/385.02; 604/385.19; 604/385.01; D24/125

(58) Field of Search ..... 604/385.01, 385.19, 604/385.02; 206/434, 494; D24/124, 125

(56) References Cited

U.S. PATENT DOCUMENTS

| | | | | |
|---|---|---|---|---|
| 3,349,993 | A | 10/1967 | Ells et al. | |
| 4,555,022 | A | 11/1985 | Eagon et al. | |
| 4,556,146 | A | 12/1985 | Swanson et al. | |
| 4,564,108 | A | 1/1986 | Widlund et al. | |
| 4,765,477 | A | 8/1988 | Fröidh et al. | |
| 4,966,286 | A | * 10/1990 | Muckenfuhs | 206/494 |
| 5,054,619 | A | * 10/1991 | Muckenfuhs | 206/610 |
| D336,130 | S | 6/1993 | Domenici | |
| 5,380,094 | A | * 1/1995 | Schmidt et al. | 383/209 |
| 5,569,230 | A | 10/1996 | Fisher et al. | |
| 5,683,377 | A | * 11/1997 | Mizutani | 604/390 |
| 5,690,625 | A | 11/1997 | Widlund | |
| 5,792,131 | A | * 8/1998 | Mizutani | 604/385.01 |
| 5,827,251 | A | 10/1998 | Moder et al. | |
| 5,993,430 | A | * 11/1999 | Gossens et al. | 604/385.01 |

FOREIGN PATENT DOCUMENTS

| | | | |
|---|---|---|---|
| DE | 3700988 | A1 | 7/1988 |
| EP | 0193130 | A2 | 9/1986 |
| EP | 0223262 | A2 | 5/1987 |
| EP | 0391460 | A1 | 10/1990 |
| EP | 0419770 | A1 | 4/1991 |
| FR | 2581619 | | 11/1986 |
| GB | 2035258 | A | 6/1980 |
| GB | 2273279 | A | 6/1994 |
| NL | 8600546 | A | 10/1987 |
| WO | WO 97/33815 | | 9/1997 |

OTHER PUBLICATIONS

US 5,699,911, 12/1997, Joseph et al. (withdrawn)

* cited by examiner

*Primary Examiner*—A. Vanatta
*Assistant Examiner*—Angela J Grayson
(74) *Attorney, Agent, or Firm*—Caesar, Rivise, Bernstein, Cohen & Pokotilow, Ltd.

(57) ABSTRACT

The combination of a package and plural absorbent pads, e.g., pantiliners. Each of the pads is an elongated generally planar member having a body engaging surface and an opposed liquid barrier surface. Each of the pads is folded along a line extending transversely to the long dimension of the pad so that its body engaging surface forms the inner surface of the folded pad and its liquid barrier surface forms the outer surface of the folded pad. The folded pads are stacked on top of one another. The package can be of various shapes, e.g., a pouch, a parallelepiped gusseted member, etc., and is formed of a flexible sheet material, e.g., a plastic film. It has a hollow interior into which the stack of pads is located. The package includes an openable mouth, e.g., a weakened or breakable line in a portion of the material making up the package, two overlapping edges of the material making up the package, etc., that is located immediately adjacent the stack of pads so that the user can grasp one of the pads to remove it from the package through the openable mouth. The folded pads may be stacked one atop another within the package with the fold line of each pad being located closely adjacent the fold line of the other pads, and with the openable mouth located closely adjacent the fold lines of the stack so that the user can grasp one of the pads at its fold line to remove it from the package through the openable mouth. Alternatively the stack of folded pads may be interleaved so that removal of one pad from the package brings a portion of another pad to the location of the openable mouth to facilitate the removal of that other pad from the package, when desired.

11 Claims, 4 Drawing Sheets

PACKAGE FOR CARRYING PLURAL PANTILINERS

FIELD OF THE INVENTION

This invention relates generally to disposable absorbent articles and more specifically to packages of disposable absorbent articles, such as pantiliners, to keep them clean, but readily removable from the package when desired for use.

BACKGROUND OF THE INVENTION

Heretofore the packaging of pantiliners, sanitary napkins, and other sanitary absorbent articles which are designed for storage in a user's purse to keep them clean until needed has been accomplished by individually wrapping each absorbent article in its own package. Typically this is accomplished by folding each of the absorbent articles and then wrapping each individually in either a plastic film or paper stock. The plural individually wrapped articles may then be packaged in a carton or a flexible plastic film bag for sale. The purchaser/user can then remove one or more of the individually wrapped articles to place it/them in her purse for later use. One example of one such a packaged product is an overnight ultrathin maxipad sold by The Kendall Confab Retail Group, a division of the assignee of this invention, under the trademark FRESH TIMES®.

The patent literature also includes numerous examples of packages for individual absorbent articles. See for example, U.S. Pat. No. 4,555,022 (Eagon et al.), U.S. Pat. No. 4,556,146 (Swanson), U.S. Pat. No. 4,765,477 (Fröidh et al.), 5,569,230 (Fisher et al.), and U.S. Pat. No. 5,827,251 (Moder) and U.S. Des. Pat. No. D336,130.

While the prior art individual packaging is generally suitable for its intended purposes it still leaves much to be desired from various standpoints. For example, if a user wishes to store several articles in her purse, the use of several individually wrapped units will inherently take up considerable space in the purse. Moreover, the individual packages can shift around so as to wind up located in various portions of the purse.

Plural disposable sanitary napkins in a single package have been disclosed in U.S. Pat. Nos. 4,564,108 (Widlund et al.) and U.S. Pat. No. 5,690,625 (Widlund).

Notwithstanding the foregoing a need exists for a package containing plural disposable absorbent sanitary articles which easily accessible to enable the ready retrieval of an article from the package while the remaining articles are kept in a clean protective environment, and which is compact in configuration and aesthetically pleasing.

SUMMARY OF THE INVENTION

The combination of a package and plural absorbent pads, e.g., pantiliners. Each of the pads is an elongated generally planar member arranged to be worn by a wearer to trap and collect fluid waste products. Each pad includes a body engaging surface and has a periphery in the form of an opposed pair of end portions and an opposed pair of side portions, with the dimensions of the side portions being longer than the end portions. Each of the pads is folded along a line extending transversely to the side portions of the pad so that its body engaging surface forms the inner surface of the folded pad. The folded pads are stacked on top of each other. The package is formed of a flexible sheet material, e.g., a plastic film, and has a hollow interior into which the stack of pads is located. The package can take various forms, e.g., a pouch, a parallelepiped shaped gusseted member, etc., and has an openable mouth, e.g., a weakened line in a portion of the material making up the package, two overlapping edges of the material making up the package, etc. The openable mouth is located immediately adjacent the stack of pads so that the user can grasp one of the pads to remove it from the package through the openable mouth.

In accordance with one aspect of the invention the folded pads are stacked one atop another with the fold line of each pad being located closely adjacent the fold line of the other pads, and with the openable mouth located closely adjacent the fold lines of the stack so that the user can grasp one of the pads at its fold line to remove it from the package through the openable mouth.

In accordance with another aspect of the invention folded pads are interleaved in the stack so that removal of one pad from the package brings a portion of another pad to the location of the openable mouth to facilitate the removal of that other pad from the package, when desired.

DETAILED DESCRIPTION OF THE PREFERRED EMBODIMENT

Figure 1:
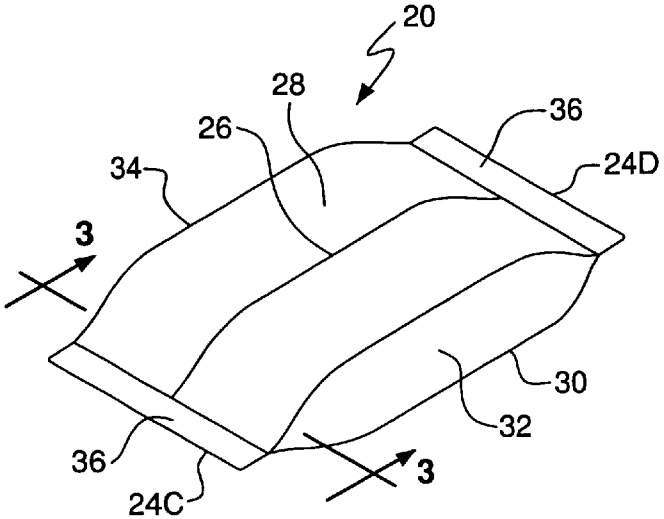
FIG. 1 is an isometric view of one embodiment of a package, e.g., a "pillow-shaped" pouch, holding plural disposable absorbent articles, e.g., pantiliners, constructed in accordance with the subject invention.

Referring now to the various figures of the drawing wherein like reference characters refer to like parts, there is shown in FIG. 1 a package 20 holding plural disposable absorbent sanitary articles constructed in accordance with one embodiment of this invention. It should be pointed out that as used herein the term "disposable" means that the article is designed to be used until soiled, either by urination, menses, or otherwise, and then discarded, rather than being washed and used again.

In the embodiment of FIG. 1 the article 22 is in the form of a pantiliner to be worn by a person within an undergarment for trapping urine or menses. Each of the pantiliners 22 is of conventional construction, such as those sold by Kendall Confab Retail Group, a division of the assignee of this invention, under the trademark FRESH TIMES®. In the interest of brevity the details of the construction of the pantiliners 22 will not be described herein. Suffice it to state that in accordance with one preferred embodiment of this invention each pantiliner 22 is a generally planar pad which has an outer sheet or layer 22A formed of a fluid-impervious, e.g., polyethylene, polypropylene or other plastic film material to form a moisture barrier, an inner liner or layer 22B formed of a fluid-pervious, e.g., a non-woven spun bonded or carded web material serving as the coverstock, and an absorbent core (not shown), e.g., an air-laid composite formed of fluff with SAP (super absorbent particles), etc., interposed between the moisture barrier and the coverstock. The top sheet may be formed of a fibrous material over the entire inner surface of the pad, or only over the inner marginal edges of the pad, and not over the intake or "target" zone (i.e., the area at which the body fluid(s) gain(s) ingress into the absorbent pad). That area may be made up of a three dimensional apertured film forming the top layer of the intake/target zone. In addition, a fluid acquisition layer formed of a fibrous material (non-woven) web may be interposed between the top sheet the a core to expedite the transfer and/or trapping of urine/menses in the pad.

The shape or outer perimeter of each pantiliner is a matter of choice or design and can be a generally hour-glass shape, a generally rounded rectangular shape, a flat oval shape, an elongated "dog-bone" shape, or any other ergonomically suitable shape.

A "position" adhesive stripe or patch (not shown) is preferably provided on the pantiliner to releasably secure the pantiliner into the crotch of an undergarment, e.g., a pair of panties, when the pantiliner is worn. In particular, in one preferred embodiment the adhesive is located on the outer layer 22A and extends for a substantial distance along the longitudinal axis of the pantiliner. A cover strip or release paper (not shown) is releasably secured over the adhesive to protect the adhesive until it is ready to be used.

When worn, the inner layer 22B of the pantiliner faces towards the body of the wearer to absorb urine, menses, etc., while the outer layer 22A prevents the urine/menses from leaking out and soiling the wearer's clothing.

In accordance with one preferred aspect of this invention each of the plural pantiliners are folded in half along a transverse fold line 22C and so that the inner layer (the body engaging surface) 22B of the two folded sections abut. This serves to protect and keep the inner layer 22B fresh and clean. The folded pantiliners 22 are then stacked one on top of the other and placed within the package 20. The details of the package 20 will be described later. Suffice it to state that the package is formed of a thin flexible sheet material which surrounds the stack of pantiliners resulting in a construction that is quite compact and can be easily stored within a purse, pocketbook, etc. For example, package constructed in accordance with this invention can contain up to ten pantiliners in a package whose size is approximately 4 inches (10.2 cm) long, 2.5 inches (6.4 cm) wide, and 0.75 inch (1.9 cm) thick, depending upon the thickness of each of the pantiliners.

Figure 3:
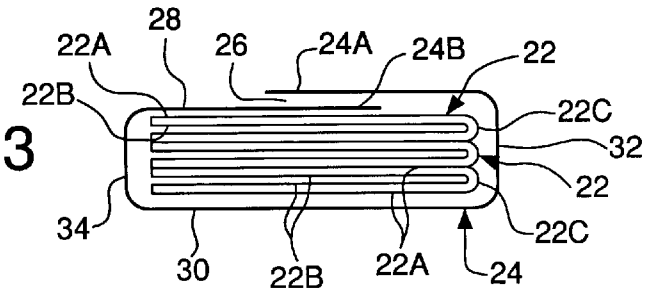
FIG. 3 is an enlarged sectional view taken along line 3—3 of FIG. 1.

In accordance with one aspect of this invention, e.g., as shown in FIGS. 1 and 3, three pantiliners 22 are stacked one on top of another within the package 20 so that the fold line 22C of each pantiliner in the stack faces in the same direction. That direction, as will be described later, faces towards an openable mouth of the package to facilitate the removal of individual pantiliners from the package, while keeping the remaining pantiliners neatly folded in the stack within the package to maintain their integrity and freshness.

As best seen in FIG. 1 the package 20 basically comprises a "pillow-shaped" pouch. In particular, the pouch is in the form of a loop 24 (FIG. 3) of a rectangular or square web of any suitable type of flexible plastic film, e.g., like that used for conventional packaging of single pantiliners. The loop 24 includes a first marginal edge 24A and a second marginal edge 24B. The first marginal edge overlies and overlaps the second marginal edge 24B to form an openable mouth 26 (FIG. 3) at their interface (i.e., where they overlap). The portions of the web contiguous with the marginal edges 24A and 24B form what can be referred to as the top panel 28 of the package 20. The package also includes what can be known as the a lower panel 30. That panel is located parallel to an spaced from the top panel by a pair of end panels 32 and 34, all of which are made up of portions of the web of material formed into the loop. The package 20 can be made quite small and compact, e.g., 60 mm wide by 80 mm long, The stack of pantiliners 22 is located within the interior of the package 20, i.e., between the top and bottom panels as shown in FIG. 3. The top and bottom panels are heat sealed together at 36 along their other marginal edges 24C and 24D to hold the stack of pantiliners within the package.

Figure 2:
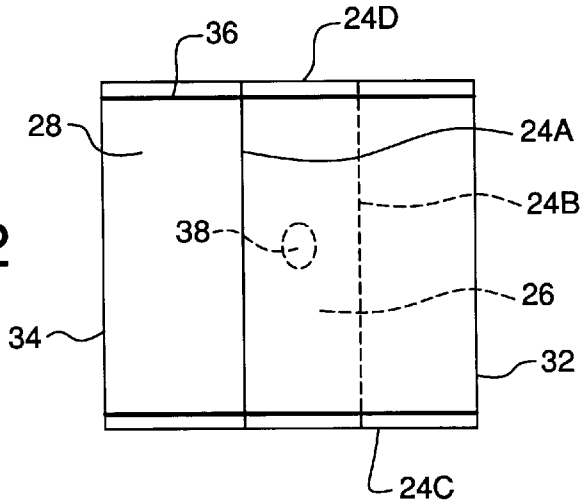
FIG. 2 is a top plan view of the package shown in FIG. 1.

In the embodiment illustrated in FIG. 3 the stack of pantiliners is oriented so that the fold lines 22C of each of the pantiliners is located adjacent the openable mouth 26. Thus, when a user wishes to remove a pantiliner 22 from the package 20, all that she has to do is to insert her thumb and index finger through the openable mouth 26 to grasp the uppermost of the pantiliners in the stack adjacent its fold line 22C. Once grasped the pantiliner 22 can then be pulled through the mouth 26. Once the pantiliner clears the mouth the marginal portions 24A and 24B of the package forming the mouth reclose (move back into their normal overlapping relationship) to effectively reseal the mouth and thereby prevent the ingress of dirt or debris into the package. Even if any dirt or debris should gain ingress into the package via the mouth 26, the fact that the remaining pantiliners within the package are folded and stacked so that their body engaging surfaces are not exposed will tend to keep them. If desired, a re-sealable adhesive area 38 (FIG. 2) can be placed at the interface of the marginal portions 24A and 24B forming the package's mouth 26 to hold the mouth closed until a pantiliner 22 is to be removed, at which time the adhesive seal 38 can be broken to open the mouth 26 and withdraw the pantiliner. Then the mouth can be resealed by the adhesive.

If desired, the pantiliners 22 may be stacked and interleaved in the package 20 in a manner akin to that commonly done with purse-size facial tissue packages. To that end the stack of pantiliners may be arranged such that they are interleaved and with their fold lines alternating in opposite directions. In particular, the upper most of the two folded portions of the lowermost pantiliner in the stack is located between the uppermost and lowermost of the two folded portions of the pantiliner immediately above it with the fold line of one pantiliner being located adjacent the end panel 32 and the fold line of the other pantiliner being located adjacent the end panel 34. The other pantiliners in the stack from that point upward are similarly interleaved. Thus, when the topmost pantiliner is withdrawn from the package through the mouth, it will carry with it a portion of the pantiliner immediately below it to facilitate the removal of that lower pantiliner from the package when desired.

Figure 4:
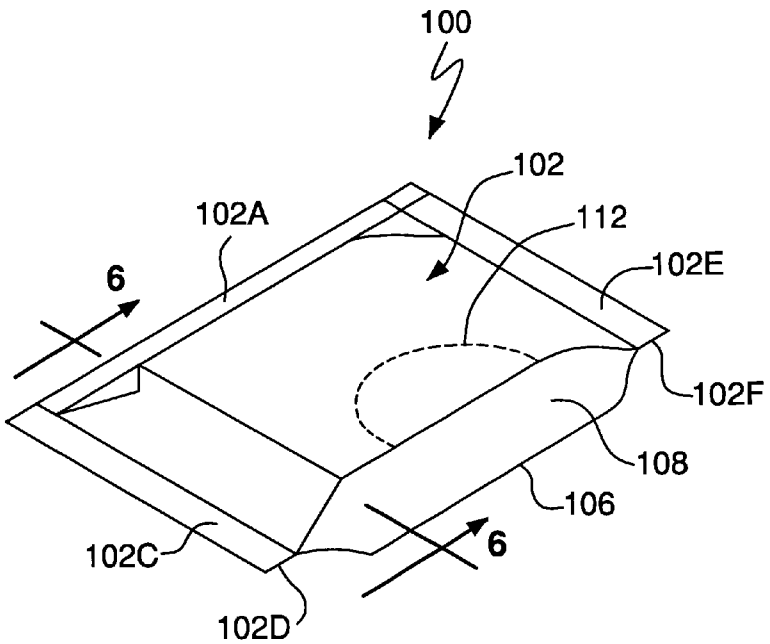
FIG. 4 is an isometric view of another embodiment of a package, e.g., a pouch, holding plural disposable absorbent articles, e.g., pantiliners, constructed in accordance with the subject invention.
Figure 6:
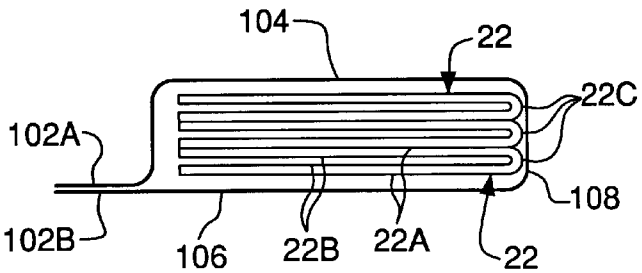
FIG. 6 is an enlarged sectional view taken along line 6—6 of FIG. 4.

In FIG. 4 there is shown an alternative "pouch" type package 100 constructed in accordance with this invention. The package 100 is similar in construction in many respects to the package 20. Thus, in the interest of brevity the same reference numbers will be given for the common components of the packages 20 and 100 and the stack of pantiliners 22 therein. The pouch 100 is a U-shaped member 102 formed of a rectangular or square web of any suitable type of flexible plastic film like that used for the package 20. The U-shaped member includes a first marginal edge 102A and a second marginal edge 102B which overlie and abut each other, a third marginal edge 102C and an fourth marginal edge 102D which overlie and abut each other, and a fifth marginal edge 102E and a sixth marginal edge 102F which overlie and abut each other. The portions of the web contiguous with the marginal edges 102A and 102B form the top panel 104 and bottom panel 106, respectively, of the package 100. The bottom panel is located parallel to and spaced from the top panel by an end panel 108. All of the panels are made up of respective portions of the web of material forming the U-shaped member 102. The stack of pantiliners 22 is located within the interior of the package 100, i.e., between the top and bottom panels as shown in FIG. 6. The top and bottom panels are heat sealed together at 110 along their abutting marginal edges 102A and 102B, 102C and 102D, and 102E and 102F to hold the stack of pantiliners within the package.

Figure 5:
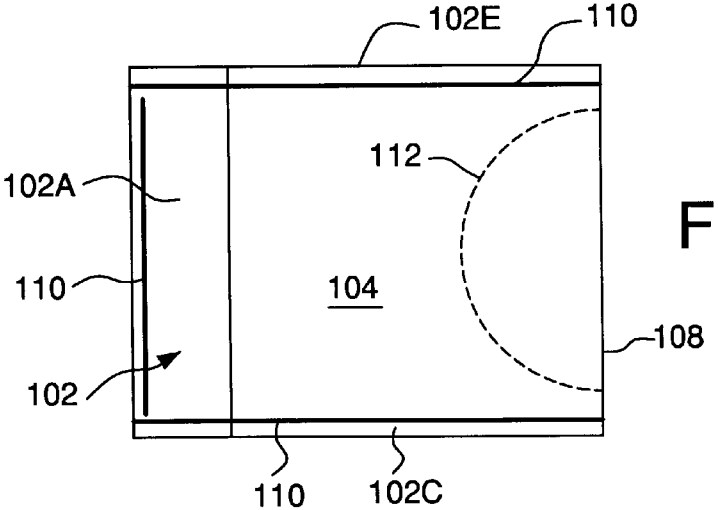
FIG. 5 is a top plan view of the package shown in FIG. 4.

A weakened or perforated line 112, in the form of a semi-circle, is located in the top panel 104 centered at the interface of that panel and the end panel 108 as can be seen in FIGS. 4 and 5. The weakened line forms the openable mouth for the package 100. In the embodiment illustrated in FIGS. 4–6 the stack of pantiliners is oriented so that the fold lines 22C of each of the pantiliners is located adjacent the openable mouth 112. Thus, when a user wishes to remove a pantiliner 22 from the package 20, all that she has to do is break open the perforated line 112 to form the mouth for the package and to insert her thumb and index finger through the mouth to grasp the uppermost of the pantiliners in the stack adjacent its fold line 22C. Once grasped the pantiliner 22 can then be pulled through the mouth 112. If desired the stack of pantiliners may be interleaved, like that described earlier, to cause a portion of the next succeeding pantiliner to be pulled out of the mouth of the package 100 after one pantiliner has been pulled therethrough.

Figure 7:
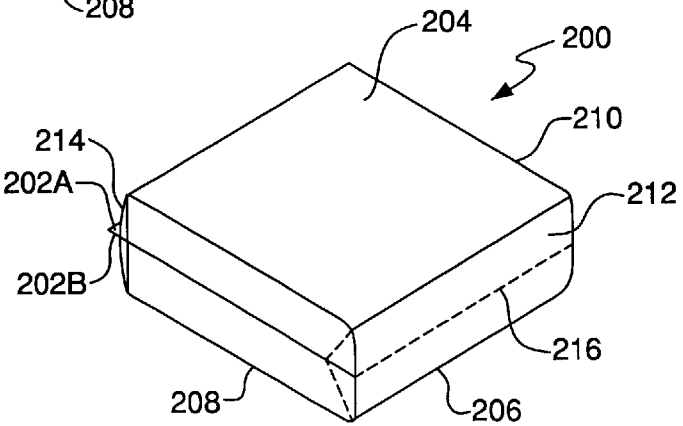
FIG. 7 is an isometric view of another embodiment of a package, e.g., a parallelepiped shaped gusseted package, holding plural disposable absorbent articles, e.g., pantiliners, constructed in accordance with the subject invention.
Figure 8:
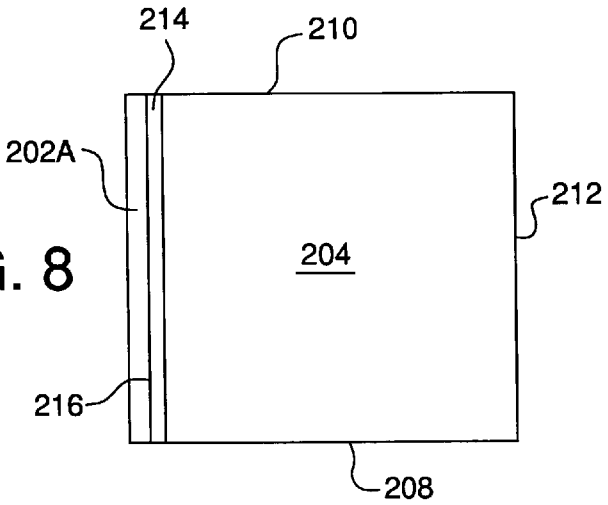
FIG. 8 is a top plan view of the package shown in FIG. 7.
Figure 10:
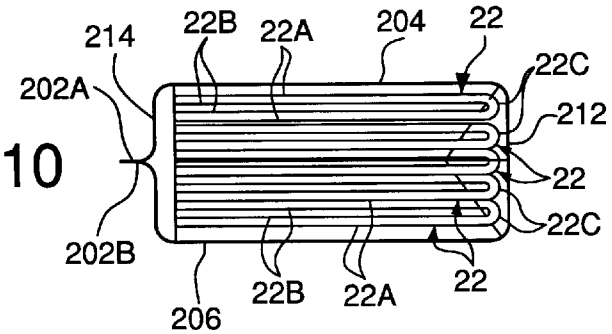
FIG. 10 is an enlarged sectional view taken along line 10—10 of FIG. 7.

In FIG. 7 there is shown another alternative package 200 constructed in accordance with this invention. The package 200 is a generally parallelepiped shaped gusseted package which is somewhat similar in construction to the packages 20 and 100 and is similar in construction to the packaging used for the heretofore identified FRESH TIMES® product. Thus, in the interest of brevity the same reference numbers will be given for the common components of the packages 20, 100 and 200 and the stack of pantiliners 22 therein. The package 200 is formed of a web of any suitable type of flexible plastic film like that used for the packages 20 and 100 and includes a first marginal edge 202A (FIGS. 7, 8 and 10) and a second marginal edge 202B (FIGS. 7 and 10) which overlie and abut each other. The package, being of a generally parallelepiped shape, includes a top panel 204, a bottom panel 206, a pair of gusseted side panels 208 and 210 located between the top and bottom panels, respectively, an inverted end panel 212, and an opposed flanged end panel 214 formed by a heat seal 216 (FIG. 8) extending along the abutting marginal edges 202A and 202B. The bottom panel is located parallel to an spaced from the top panel by the end and side panels to form a hollow interior in which a stack of five pantiliners 22 is located. All of the panels of the package 200 are made up of respective portions of the web of material forming the package. The stack of pantiliners 22 is located within the interior of the package between the top and bottom panels as shown in FIG. 10.

Figure 9:
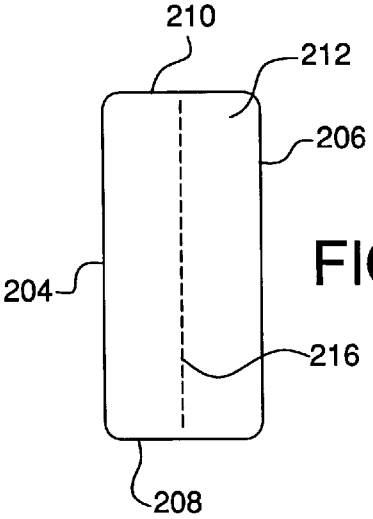
FIG. 9 is an end view of the package shown in FIG. 7.

A weakened or perforated line 216, in the form of a straight line, is located in the inverted end panel 212 centered between the top panel 204 and the bottom panel 206 as can be seen in FIGS. 7 and 9. The weakened line 216 forms the openable mouth for the package 200. In the embodiment illustrated in FIGS. 7–10 the stack of pantiliners is oriented so that the fold line 22C of each of the pantiliners is located adjacent the openable mouth 216. Thus, when a user wishes to remove a pantiliner 22 from the package 20, all that she has to do is break open the perforated line 216 of the end panel 212 to form the mouth for the package and to insert her thumb and index finger through the mouth to grasp the uppermost of the pantiliners in the stack adjacent its fold line 22C. Once grasped the pantiliner 22 can then be pulled through the mouth 216. If desired the stack of pantiliners may be interleaved, like that described earlier, to cause a portion of the next succeeding pantiliner to be pulled out of the mouth of the package 200 after one pantiliner has been pulled therethrough.

Figure 11:
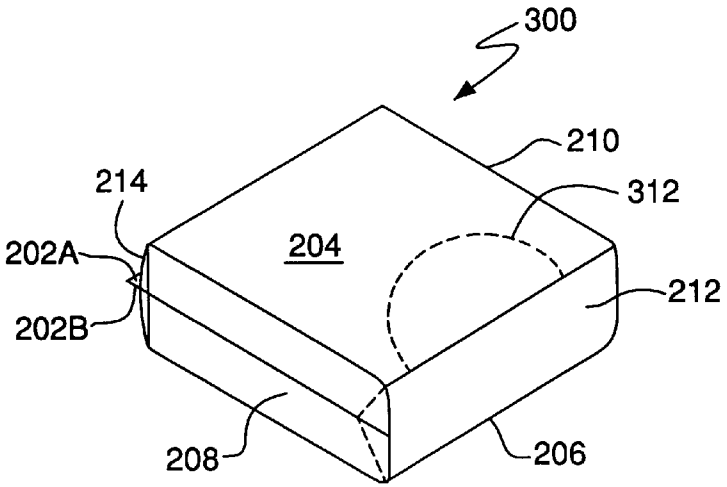
FIG. 11 is an isometric view of another embodiment of a package, e.g., a parallelepiped shaped gusseted package, holding plural disposable absorbent articles, e.g., pantiliners, constructed in accordance with the subject invention.

In FIG. 11 there is shown another alternative package 300 constructed in accordance with this invention. The package 300 is identical in construction to the package 200 except for the construction of the openable mouth. Thus, in the interest of brevity the same reference numbers will be given for the common components of the packages 200 and 300 and the stack of pantiliners 22 therein, and the details of that construction will not be reiterated.

Figure 12:
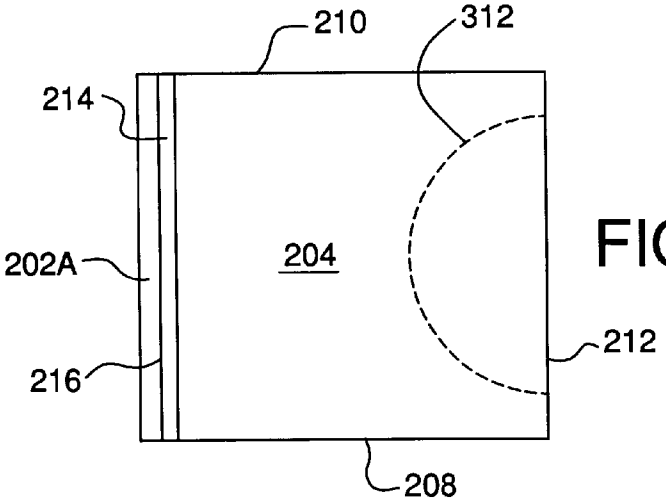
FIG. 12 is a top plan view of the package shown in FIG. 7.
Figure 13:
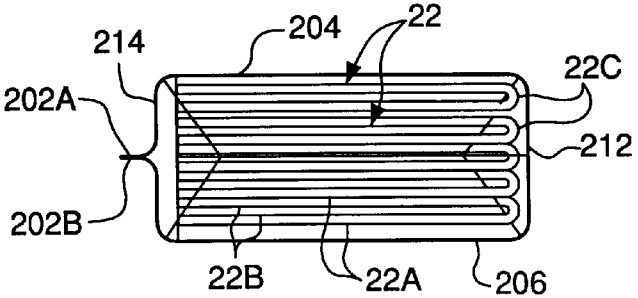
FIG. 13 is an enlarged sectional view taken along line 13—13 of FIG. 10.

The openable mouth for the package 300 is not located within the end panel 212, but instead is located in the top panel 204. In particular, a weakened or perforated line 312, in the form of a semi-circle, like that described earlier, is located in the top panel 204 centered at the interface of that panel and the end panel 212 as can be seen in FIGS. 11 and 12. The stack of pantiliners is oriented within the package 300 so that the fold lines 22C of each of the pantiliners is located adjacent the openable mouth 312. Thus, when a user wishes to remove a pantiliner 22 from the package 300, all that she has to do is break open the perforated line 312 to form the mouth for the package and to insert her thumb and index finger through the mouth to grasp the uppermost of the pantiliners in the stack adjacent its fold line 22C. Once grasped the pantiliner 22 can then be pulled through the mouth 312. If desired the stack of pantiliners may be interleaved, like that described earlier, to cause a portion of the next succeeding pantiliner to be pulled out of the mouth of the package 300 after one pantiliner has been pulled therethrough.

It is contemplated that the flexible material used to form the packages of this invention be opaque to hide the contents of the package, so that the pantiliners may be held discreetly within a woman's purse or pocketbook. Moreover, the packaging material may have indicia, e.g., floral motifs, geometric patterns, etc., printed thereon or otherwise applied to provide an aesthetically pleasing or decorative appearance.

It should be pointed out at this juncture that other modifications to the packages of this invention are also contemplated. For example, the packages need not be formed of flexible materials, such a plastic films, but may be formed of cardboard or other paperboard stock or other materials used for forming relatively rigid cartons. Moreover, the pantiliners need not be folded in two as described above, but may be folded into more than two sections, if desired. In fact, in some applications, it may be desired to leave the pantiliners unfolded within the package.

Without further elaboration the foregoing will so fully illustrate my invention that others may, by applying current or future knowledge, adopt the same for use under various conditions of service.

I claim:

1. In combination a package and plural absorbent pads, each of said pads being an elongated generally planar member arranged to be worn by a wearer to trap and collect fluid waste products of the wearer, each of said pads having a body engaging surface and having a periphery in the form of an opposed pair of end portions and an opposed pair of side portions, the dimensions of the side portions being longer than the end portions, each of said pads being folded along a line extending transversely to the side portions thereof, whereupon said body engaging surface of each of said folded pads forms the inner surface of said folded pad, said folded pads being in the form of a stack, said folded pads being interleaved in said stack, said package being formed of a flexible sheet material and having a hollow interior into which said stack of pads is located, said package having an openable mouth, said openable mouth being located immediately adjacent said stack of pads, whereupon a user can grasp one of said pads to remove the grasped pad from the package through said openable mouth and whereupon removal of one pad from said package brings a portion of another pad to the location of the openable mouth to facilitate the removal of said another pad from the package, when desired.

2. The combination of claim 1 wherein said openable mouth is located immediately adjacent said stack of pads to expose only a single pad of the package, whereupon a user can grasp said exposed pad to remove the grasped pad from the package through said openable mouth, said mouth being reclosable to keep the remaining pads in the package clean.

3. The combination of claim 1 wherein said openable mouth is automatically reclosable.

4. The combination of claim 1 wherein said package is approximately 4 inches (10.2 cm) long, 2.5 inches (6.4 cm) wide, and 0.75 inch (1.9 cm) thick.

5. In combination a package and plural absorbent pads, each of said pads being an elongated generally planar member arranged to be worn by a wearer to trap and collect fluid waste products of the wearer, each of said pads having a body engaging surface and having a periphery in the form of an opposed pair of end portions and an opposed pair of side portions, the dimensions of the side portions being longer than the end portions, each of said pads being folded along a line extending transversely to the side portions thereof, whereupon said body engaging surface of each of said folded pads forms the inner surface of said folded pad, said folded pads being in the form of a stack, said package comprising a generally pillow shaped pouch comprising a tube of flexible sheet material having a hollow interior into which said stack of pads is located, said tube of flexible material having two marginal edges which overlap each other to form an openable and automatically reclosable mouth, said mouth being located immediately adjacent said stack of pads, whereupon a user can open said mouth and introduce her fingers therethrough to grasp one of said pads to remove the grasped pad from the package through said mouth, whereupon said mouth recloses to keep the remaining pads in the package clean.

6. The combination of claim 5 wherein said folded pads are interleaved in said stack.

7. In combination a package and plural absorbent pads, each of said pads being an elongated generally planar member arranged to be worn by a wearer to trap and collect fluid waste products of the wearer, each of said pads having a body engaging surface and having a periphery in the form of an opposed pair of end portions and an opposed pair of side portions, the dimensions of the side portions being longer than the end portions, each of said pads being folded along a line extending transversely to the side portions thereof, whereupon said body engaging surface of each of said folded pads forms the inner surface of said folded pad, said folded pads being in the form of a stack, said package being formed of a flexible sheet material and having a hollow interior into which said stack of pads is located, said package comprising a generally pillow shaped pouch comprising a tube of flexible material having a generally U-shaped configuration and marginal edges, said tube being sealed along its marginal edges and having a front panel and a rear panel, one of said front or rear panels including an openable mouth, said openable mouth being located immediately adjacent said stack of pads to expose only a single pad of the package, whereupon a user can grasp said exposed pad to remove the grasped pad from the package through said openable mouth, said mouth being reclosable to keep the remaining pads in the package clean.

8. The combination of claim 7 wherein said openable mouth comprises a weakened line in said flexible material.

9. The combination of claim 8 wherein said weakened line is arcuate.

10. In combination a package and plural absorbent pads, each of said pads being an elongated generally planar member arranged to be worn by a wearer to trap and collect fluid waste products of the wearer, each of said pads having a body engaging surface and having a periphery in the form of an opposed pair of end portions and an opposed pair of side portions, the dimensions of the side portions being longer than the end portions, each of said pads being folded along a line extending transversely to the side portions thereof, whereupon said body engaging surface of each of said folded pads forms the inner surface of said folded pad, said folded pads being in the form of a stack, said package being formed of a flexible sheet material and having a hollow interior into which said stack of pads is located, said package being approximately 4 inches (10.2 cm) long, 2.5 inches (6.4 cm) wide, and 0.75 inch (1.9 cm) thick and having an openable mouth, said openable mouth being located immediately adjacent said stack of pads, whereupon a user can grasp one of said pads to remove the grasped pad from the package through said openable mouth.

11. The combination of claim 10 wherein said package is of a parallelepiped shape.

* * * * *